US007997292B2

(12) United States Patent
Scherer

(10) Patent No.: US 7,997,292 B2
(45) Date of Patent: Aug. 16, 2011

(54) PORTABLE STRUCTURE WITH LINKING POLE

(75) Inventor: Michael James Scherer, Louisville, CO (US)

(73) Assignee: Inkling, Inc., Louisville, CO (US)

( * ) Notice: Subject to any disclaimer, the term of this patent is extended or adjusted under 35 U.S.C. 154(b) by 8 days.

(21) Appl. No.: 12/830,127

(22) Filed: Jul. 2, 2010

(65) Prior Publication Data

US 2010/0263699 A1 Oct. 21, 2010

Related U.S. Application Data

(63) Continuation of application No. 11/734,119, filed on Apr. 11, 2007, now Pat. No. 7,766,023, which is a continuation-in-part of application No. 11/033,063, filed on Jan. 11, 2005, now abandoned.

(60) Provisional application No. 60/536,095, filed on Jan. 12, 2004.

(51) Int. Cl.
*E04H 15/48* (2006.01)
*E04H 15/32* (2006.01)

(52) U.S. Cl. ..... 135/147; 135/135; 135/120.3; 135/126

(58) Field of Classification Search ..... 135/124, 135/125, 126, 128, 135, 143, 147, 120.3
See application file for complete search history.

(56) References Cited

U.S. PATENT DOCUMENTS

| | | | | |
|---|---|---|---|---|
| 3,909,993 | A | 10/1975 | Huddle | |
| 4,265,259 | A | 5/1981 | Gillis | |
| D260,227 | S | 8/1981 | Bentson | |
| 4,393,887 | A * | 7/1983 | Orribin | 135/153 |
| 4,998,552 | A | 3/1991 | Niksic et al. | |
| 5,069,572 | A | 12/1991 | Niksic | |
| 5,301,706 | A * | 4/1994 | Jones | 135/125 |
| 5,333,634 | A | 8/1994 | Taylor | |
| 5,361,794 | A * | 11/1994 | Brady | 135/147 |
| 5,901,727 | A | 5/1999 | Kramer et al. | |
| 5,930,971 | A * | 8/1999 | Etheridge | 52/646 |
| 5,950,649 | A | 9/1999 | Gerig | |
| 6,227,218 | B1 | 5/2001 | Breaux | |
| 6,279,208 | B1 | 8/2001 | Gillis | |
| 2001/0017564 | A1 | 8/2001 | Mazzucco et al. | |
| 2002/0020439 | A1 * | 2/2002 | Tate | 135/124 |
| 2003/0178055 | A1 | 9/2003 | Laakso et al. | |
| 2004/0168715 | A1 * | 9/2004 | Wang | 135/124 |
| 2005/0092355 | A1 | 5/2005 | Hsu | |

OTHER PUBLICATIONS

Recreational Equipment Incorporated (REI), Expedition Tents, 1979, p. 85, Seattle, Washington.
U.S. Appl. No. 11/734,119, selected pages from Image File Wrapper dated May 27, 2009 through Jul. 14, 2010, 60 pages.
U.S. Appl. No. 11/033,063, selected pages from Image File Wrapper dated Oct. 11, 2006 through May 18, 2007, 15 pages.

* cited by examiner

*Primary Examiner* — David Dunn
*Assistant Examiner* — Danielle Jackson
(74) *Attorney, Agent, or Firm* — Lathrop & Gage LLP

(57) ABSTRACT

A portable structure includes first and second support poles, each having one lower end for resting on a ground surface. First and second connectors attach at upper ends of the first and second support poles, respectively and two or more linking poles connect the first support pole with the second support pole via the first and second connectors. The linking poles form obtuse angles with the first and second support poles at the first and second connectors. The linking poles form an eye shape between the first and second support poles when joined with the connectors.

21 Claims, 15 Drawing Sheets

FIG. 15
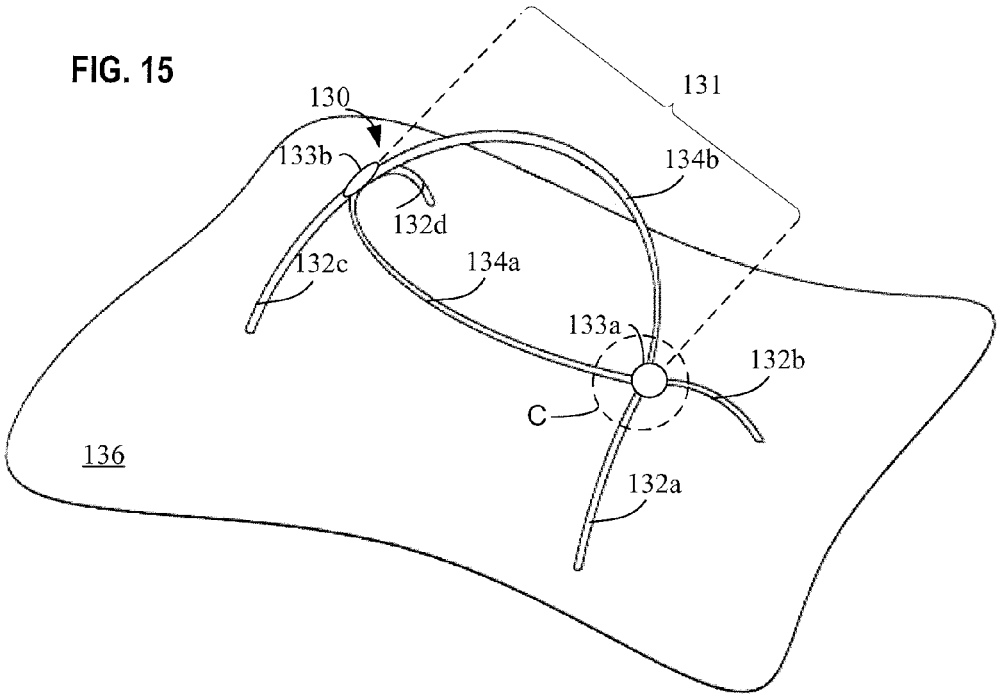
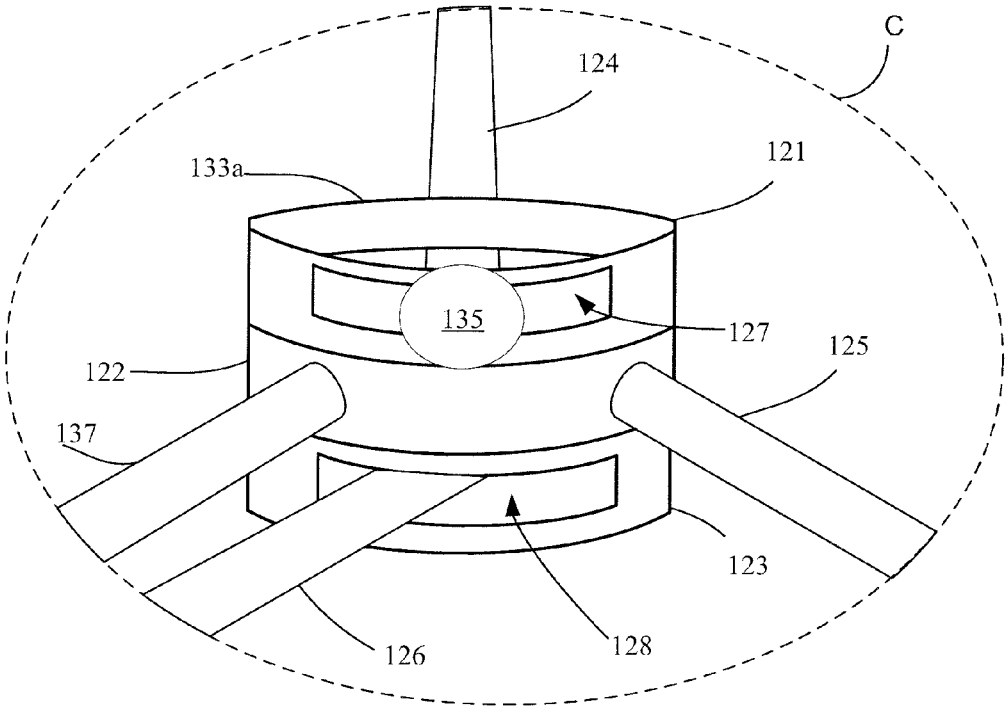
FIG. 16

PORTABLE STRUCTURE WITH LINKING POLE

RELATED APPLICATIONS

This application is a continuation of U.S. patent application Ser. No. 11/734,119, filed Apr. 11, 2007, now U.S. Pat. No. 7,766,023 which is a continuation-in-part of U.S. patent application Ser. No. 11/033,063, filed Jan. 11, 2005, now abandoned which claims priority to U.S. Provisional Patent Application Ser. No. 60/536,095, filed Jan. 12, 2004.

BACKGROUND

Portable structures such as tents are used in a variety of recreational and sporting activities. For some activities, the most desirable qualities of a tent are roominess and convenience; for other activities, the most desirable qualities are small size and light weight. Tents are typically supported by poles. For example, a tent made of fabric may be erected with poles either inside or outside the tent; and the fabric may connect with the poles at support points. The flexible fabric of the tent sags between the support points, leading to reduced space and impaired headroom in regions of the tent that are distant from support points.

SUMMARY

In one embodiment, a portable structure includes first and second support poles, each having one lower end for resting on a ground surface. First and second connectors attach at upper ends of the first and second support poles, respectively and two or more linking poles connect the first support pole with the second support pole via the first and second connectors. The linking poles form obtuse angles with the first and second support poles at the first and second connectors. The linking poles form an eye shape between the first and second support poles when joined with the connectors.

A stackable hub includes a top member forming an open channel that accommodates movement of a moveable attachment fixture therein and a bottom member connected with the top member and including at least two attachment fixtures extending therefrom. The movement of the moveable attachment fixture along the open channel adjusts an angle between the movable attachment fixture and at least one of the attachment fixtures extending from the bottom member.

A portable structure includes first, second, third and fourth support poles each having one end resting on ground. First, second, third and fourth linking pole connects with the first, second, third and fourth support pole. A first connector attaches the first support pole, the first linking pole and the third linking pole when the first support pole is in an upright configuration. A second connector attaches the second support pole, the second linking pole and the third linking pole when the second support pole is in the upright configuration. A third connector attaches the third support pole, the first linking pole and the fourth linking pole when the second support pole is in the upright configuration. A fourth connector attaches the fourth support pole, the second linking pole and the fourth linking pole when the second support pole is in the upright configuration. Each angle formed between the linking poles and the support poles is an obtuse angle.

A portable structure includes first, second, third and fourth support poles, each of the support poles having exactly one lower end for resting on a ground surface and two linking poles. A first connector attaches upper ends of the first and second support poles with a first end of each of the linking pole and a second connector attaches upper ends of the third and fourth support poles with a second end of each of the linking poles. The linking poles form an eye shape when joined with the connectors.

BRIEF DESCRIPTION OF DRAWINGS

FIG. 15 shows another portable structure with a linking pole.

FIG. 16 is an enlarged perspective view of region C of FIG. 15, in one embodiment.

DETAILED DESCRIPTION OF DRAWINGS

Figure 1:
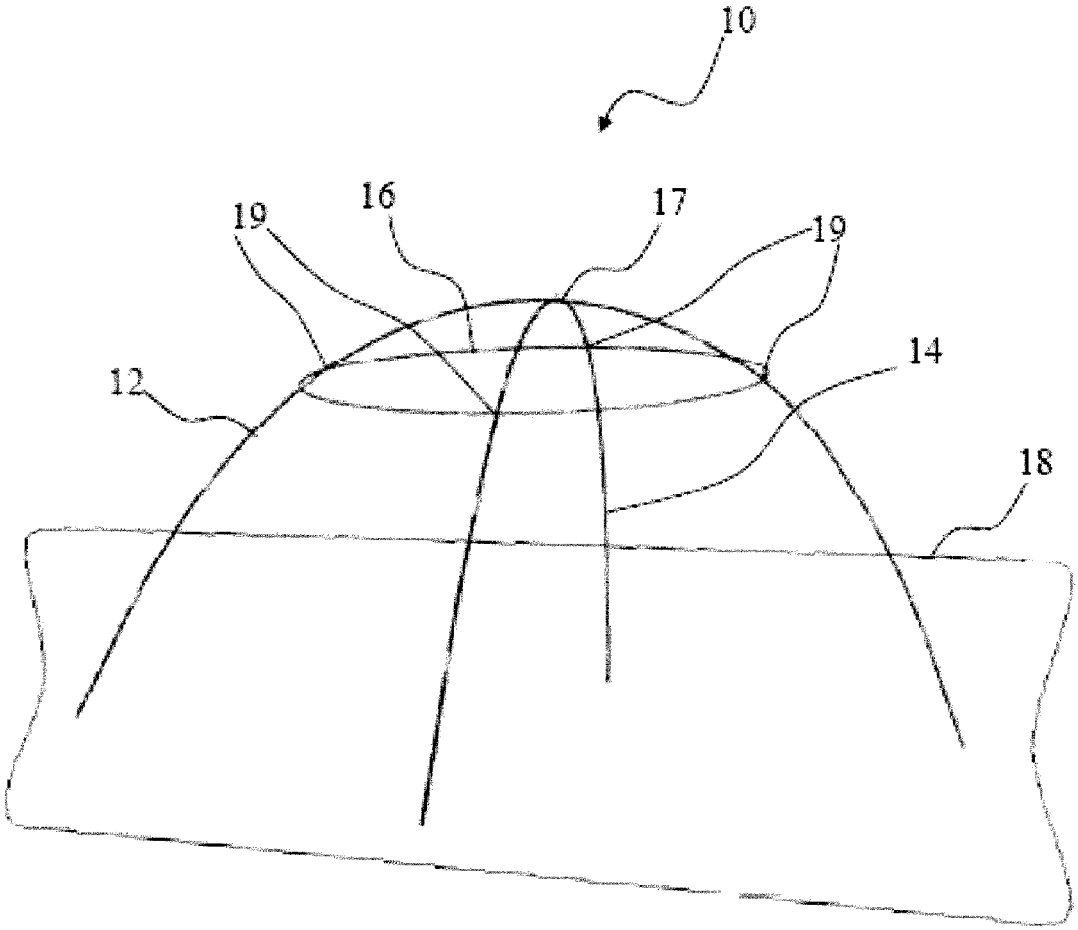
FIG. 1 shows one portable structure with a linking pole.

FIG. 1 shows first pole 12, second pole 14 and third pole 16 that form a portable structure 10. In structure 10, pole 16 may be considered a "linking" pole while poles 12 and 14 may be considered "support" poles. Structure 10 is for example suitable to support tent fabric to form a tent. The ends of first pole 12 and second pole 14 are on a ground surface 18, and each form an arc, as shown. Linking pole 16 is, in the illustrated example, oval-shaped. First pole 12 crosses second pole 14 at crossing point 17. Linking pole 16 crosses support poles 12, 14 at crossing points 19, as shown in FIG. 1.

Figure 2:
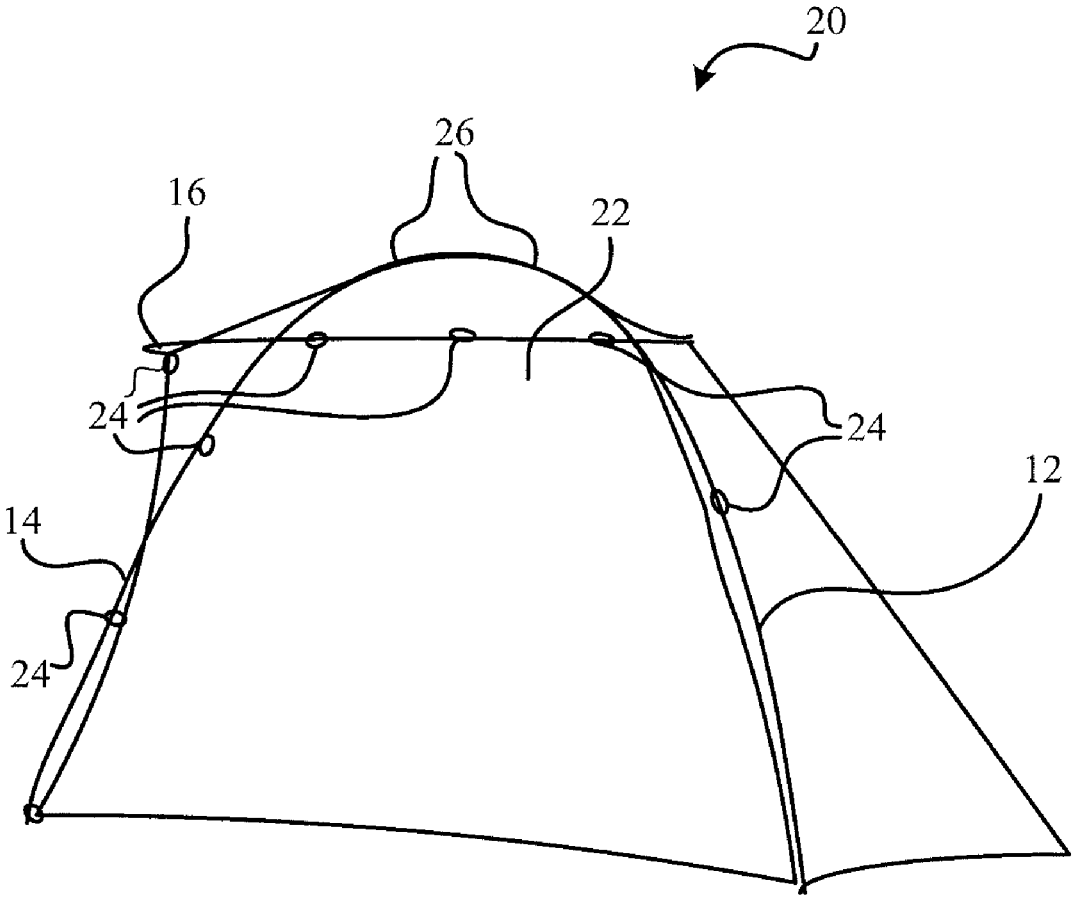
FIG. 2 is a side view of a tent using the portable structure of FIG. 1.

FIG. 2 shows a side view of a tent 20, including poles 12, 14, and 16 of FIG. 1. Poles 12, 14, and 16 support tent fabric 22. First pole 12 and second pole 14 are, for example, segmented poles connected with a shock cord. Third pole 16 raises tent fabric 22 in areas of tent 20 that are not adjacent to poles 12 and 14, thus increasing the internal volume of tent 20. Any pole that rests on the ground, thus providing support for a portable structure or other poles thereof (e.g., poles 12 and 14) will be called a "support pole" herein. Any pole supported exclusively by other poles (e.g., pole 16) or by fabric of a portable structure will be called a "linking pole" herein. "Supported exclusively" by another pole includes use of a connector or fabric to connect a linking pole (e.g., pole 16) to a support pole (e.g., poles 12 and 14). Tent fabric 22 attaches to poles 12, 14, and 16 by multiple clips 24 (see FIG. 9). Poles 12 and 14 may also pass through sleeves 26 of tent 20.

Figure 3:
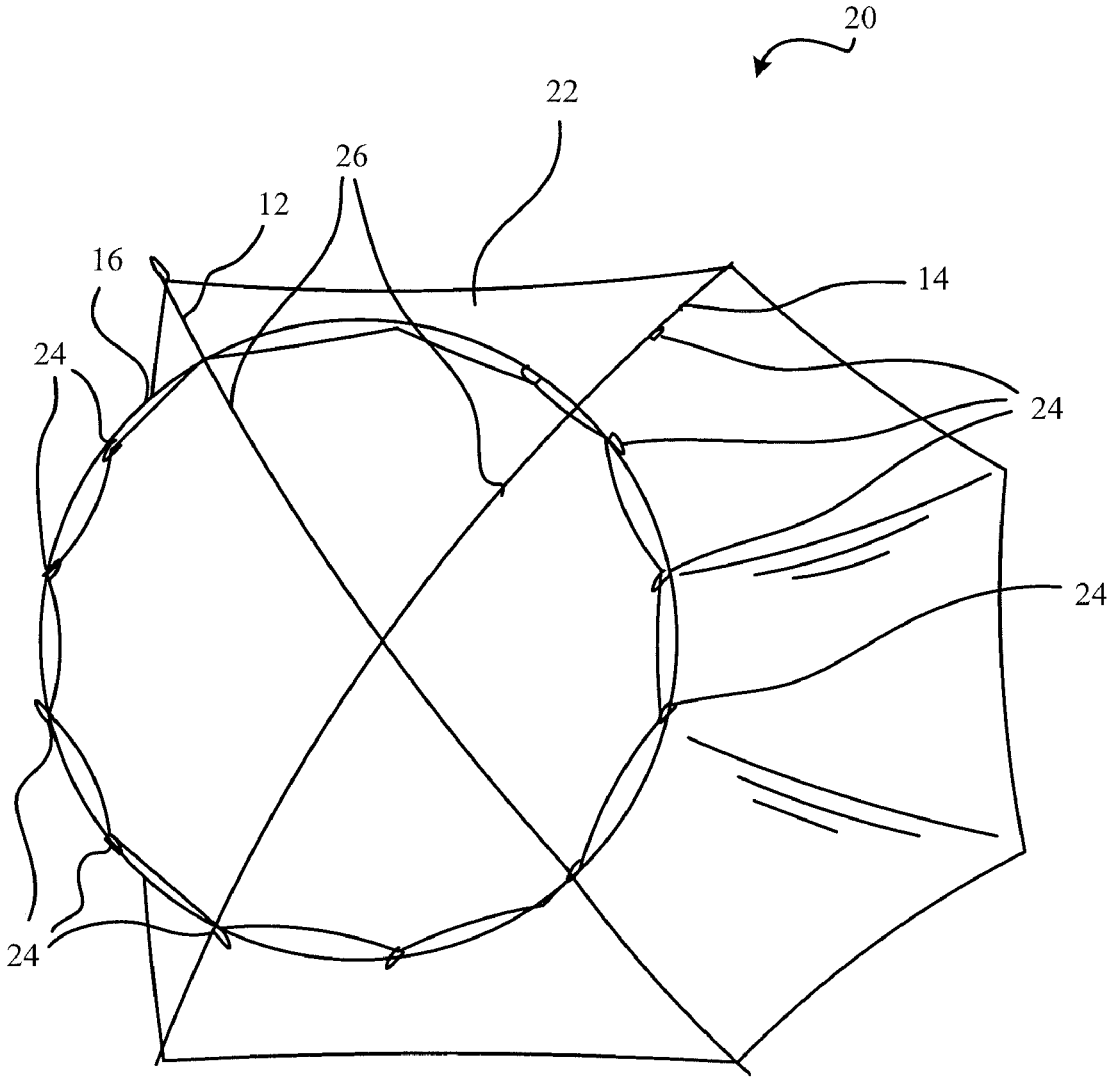
FIG. 3 is a top view of the tent of FIG. 2.

FIG. 3 shows a top view of tent 20 of FIG. 2.

Figure 4:
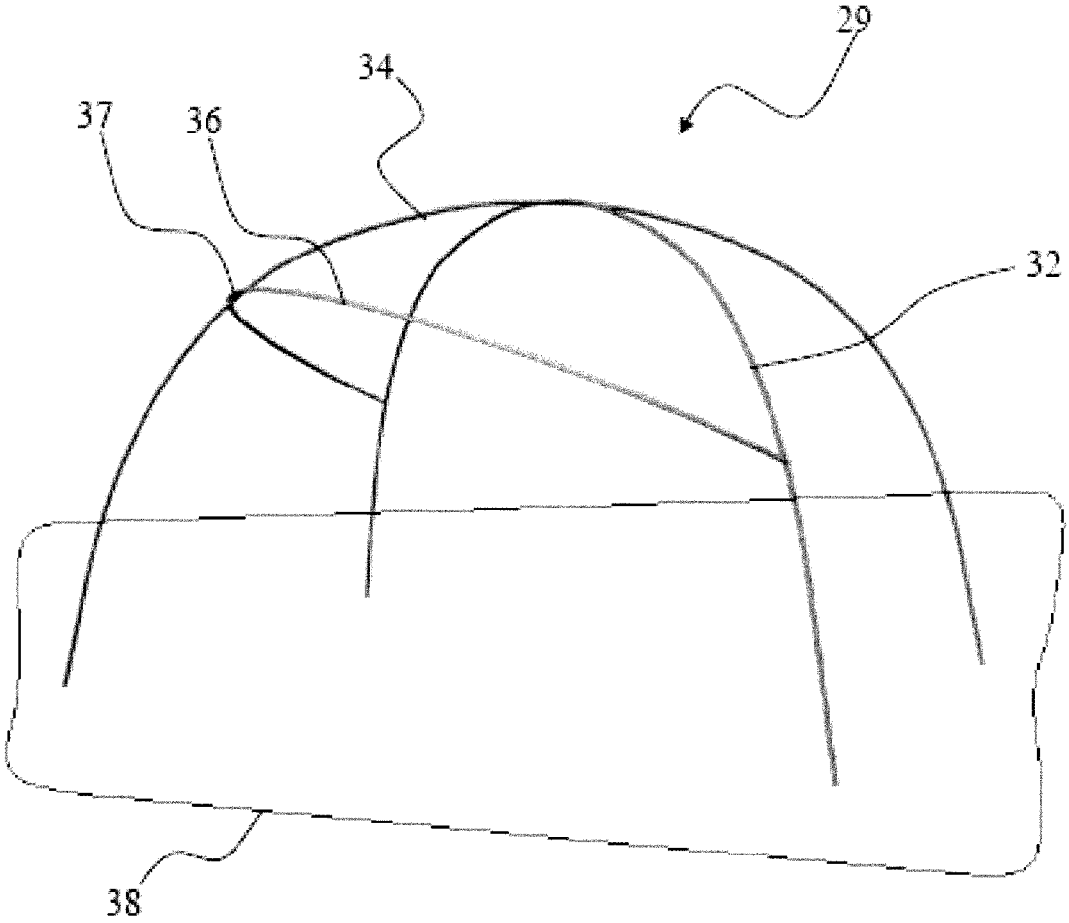
FIG. 4 shows another portable structure with a linking pole.

The use of a linking pole is not limited to a ring form, as in FIG. 1, where pole 16 connects with itself, thereby having no end as assembled. For example, FIG. 4 shows another portable structure 29 with a linking pole 36. Structure 29 also has a first pole 32 and a second pole 34. All three poles 32, 34, 36 may support a tent, as in FIG. 2 and FIG. 3. The ends of first pole 32 and second pole 34 are on a ground surface 38. First pole 32 supports the ends of linking pole 36, as shown; second pole 34 also supports linking pole 36 where linking pole 36 crosses second pole 34 at crossing point 37, as shown. Linking pole 36 thus supports tent fabric (not shown) to increase headroom in the regions where linking pole 36 is not adjacent to first and second poles 32 and 34 (in a manner similar to pole 16 supporting tent fabric 22 in FIG. 2 and FIG. 3).

Figure 5:
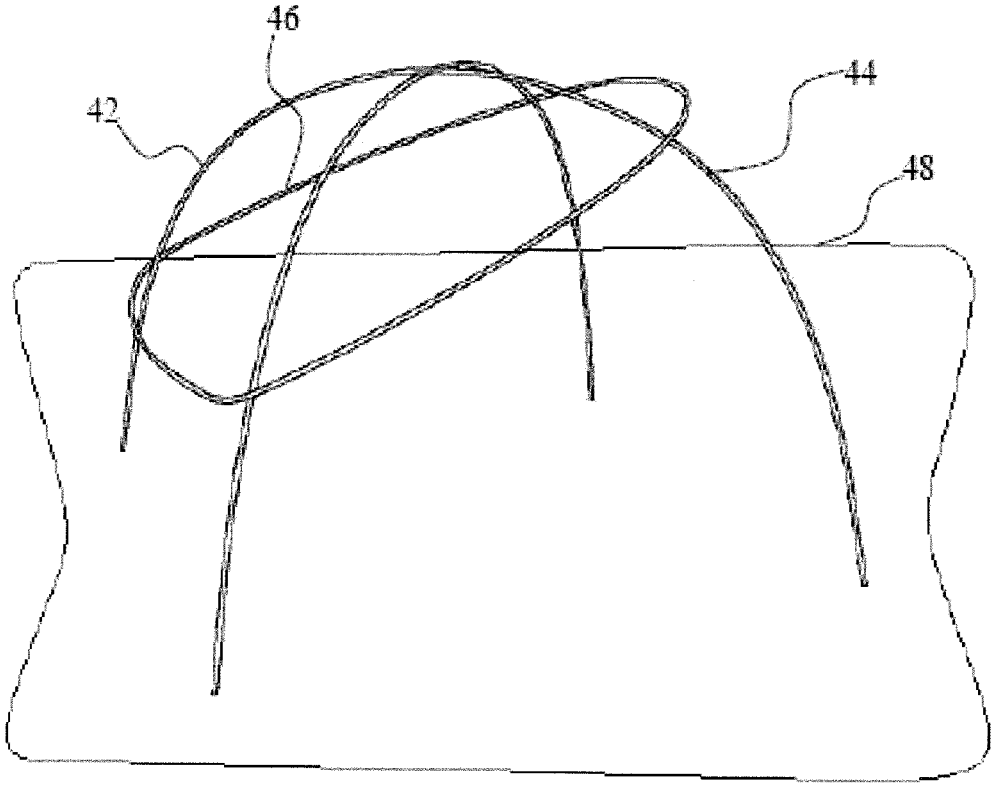
FIG. 5 shows another portable structure with a linking pole.

Other linking pole designs are within the scope of this disclosure. For example, FIG. 5 shows a first pole 42, a second pole 44, and a linking pole 46, which may cooperate to support a tent. The ends of first pole 42 and second pole 44 are on a ground surface 48. First pole 42 and second pole 44 support linking pole 46. FIG. 5 shows that linking pole 46 is situated at an angle with respect to ground surface 48. As above, linking pole 46 supports a tent fabric in regions that are not adjacent to first and second poles 42 and 44 (in a manner similar to pole 16 supporting tent fabric 22 in FIG. 2 and FIG. 3). Other embodiments within the scope hereof utilize multiple linking poles.

Figure 6:
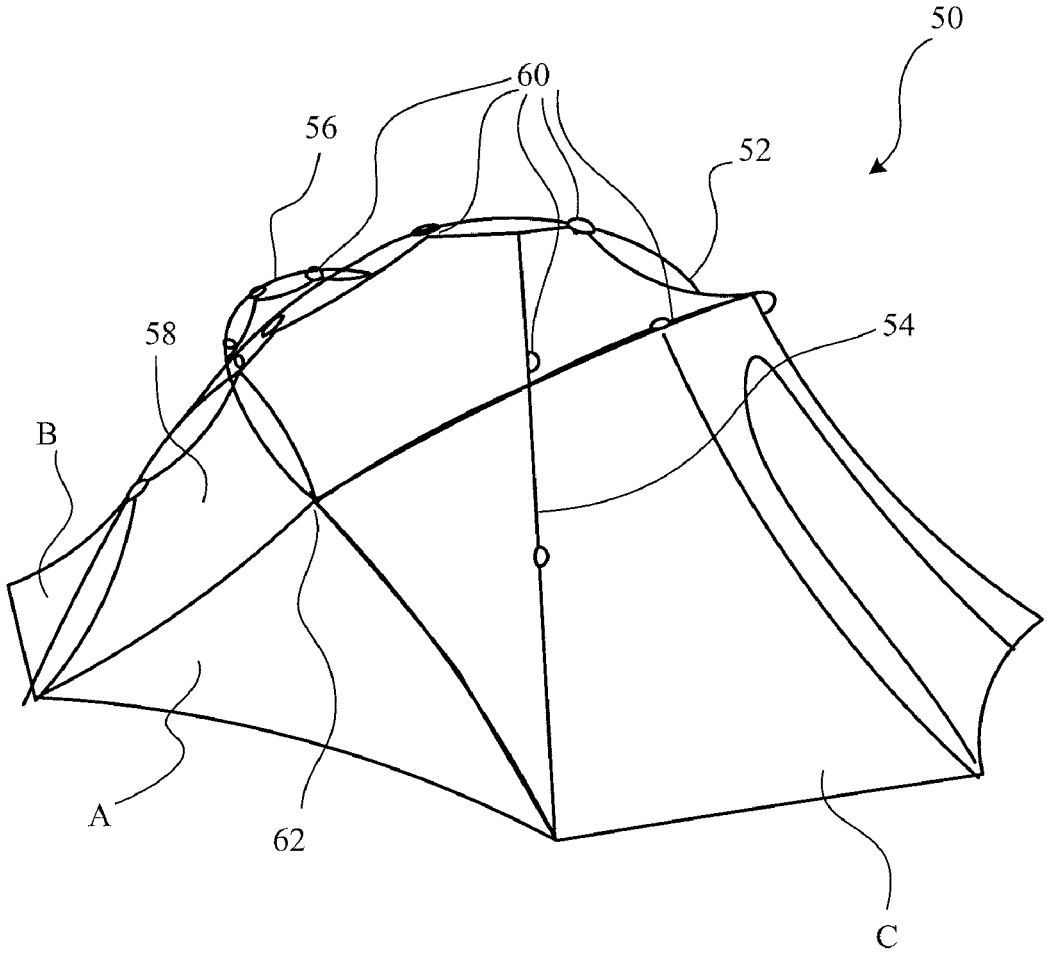
FIG. 6 shows one tent including a portable structure.

FIG. 6 shows one tent 50 supported by first and second poles 52 and 54, and a linking pole 56. Tent fabric 58 attaches to poles 52, 54, and 56 with multiple clips 60 (only a few examples of clips 60 are labeled, for purposes of illustration). FIG. 6 identifies sections A, B, and C of tent 50. Each of these sections is a quadrant of the tent, bounded by first and second poles 52 and 54. Section A is completely visible, sections B and C are partially visible, while section D is completely hidden. Linking pole 56 has a discontinuous bend 62 (i.e. discontinuous bend 62 is a sharper bend in linking pole 56 than in the other parts of linking pole 56 visible in FIG. 6). Linking pole 56 also bends discontinuously as it traverses hidden section D. Discontinuous bend 62 of linking pole 56, and the corresponding bend as linking pole 56 traverses hidden section D, serve to increase the height of linking pole 56 and lift tent fabric 58 as it traverses sections B and C, and thereby increase the internal volume within tent 50.

One skilled in the art of tent design will appreciate that other embodiments of a linking pole may have integrated discontinuous bends, corners, or other features, to lift (or lower) tent fabric in selected regions, as matters of design choice. Tent fabric or other features may also be configured in various ways to match the use of linking poles, including linking poles with integrated bends or corners. For example, a linking pole may extend upward as it traverses a particular region of a tent, and the tent fabric may be configured in this region to match the geometry of the linking pole, creating extra space inside the tent. The extra space inside the tent may be used for increased headroom, or may be used in other ways, such as for storage features.

Integration of bends, corners, and other features into a tent pole (e.g., a linking pole) may require that one or more sections of the tent pole always face a certain direction. However, typical shock-corded tent pole sections are radially symmetric about a cord, and the joints between sections may rotate when torque is applied. In one embodiment, therefore, a tent pole includes keyed joints, wherein each joint of the pole includes mechanical features that allow assembly of the joint in only one orientation, thereby keeping all sections of the pole in the orientation in which they are assembled. One example of a tent pole with keyed joints is a tent pole in which joints (and optionally sections) are not circular in cross section.

Figure 7:
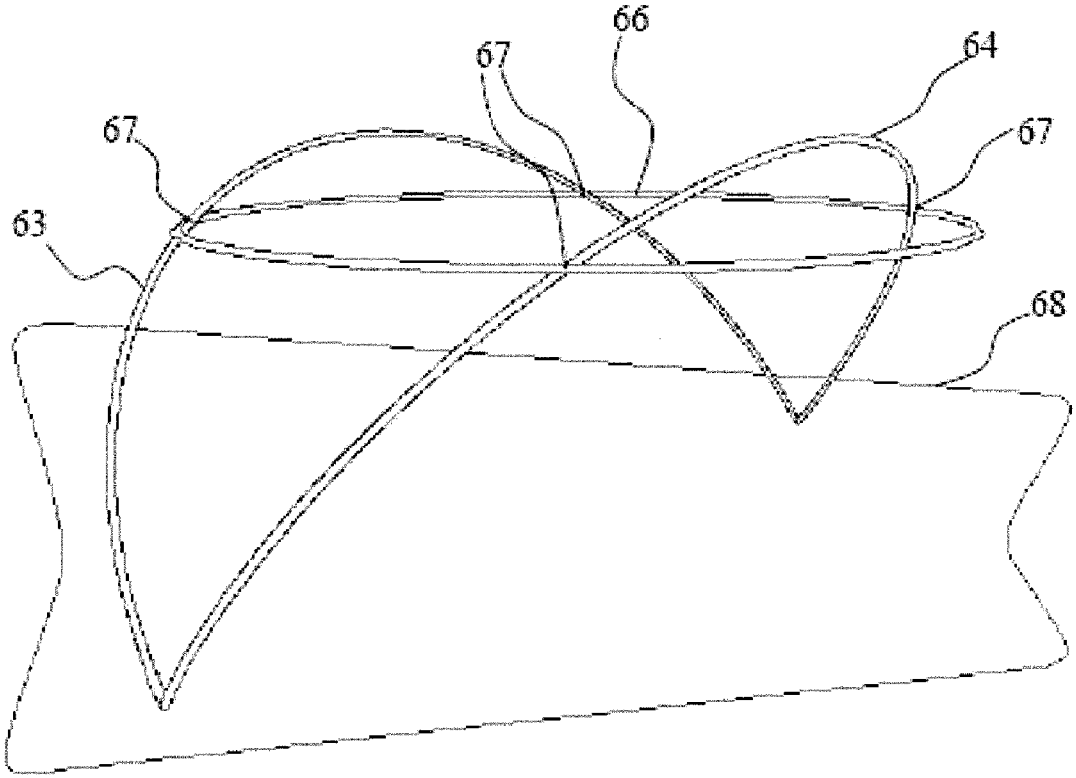
FIG. 7 shows another portable structure with a linking pole.

FIG. 7 shows a first pole 63, a second pole 64, and a linking pole 66, which may cooperate to support a tent. The ends of first pole 63 and second pole 64 are on a ground surface 68. Linking pole 66 crosses first pole 63 and second pole 64 at crossing points 67. First pole 63 and second pole 64 support linking pole 66 at crossing points 67, as shown.

Figure 8:
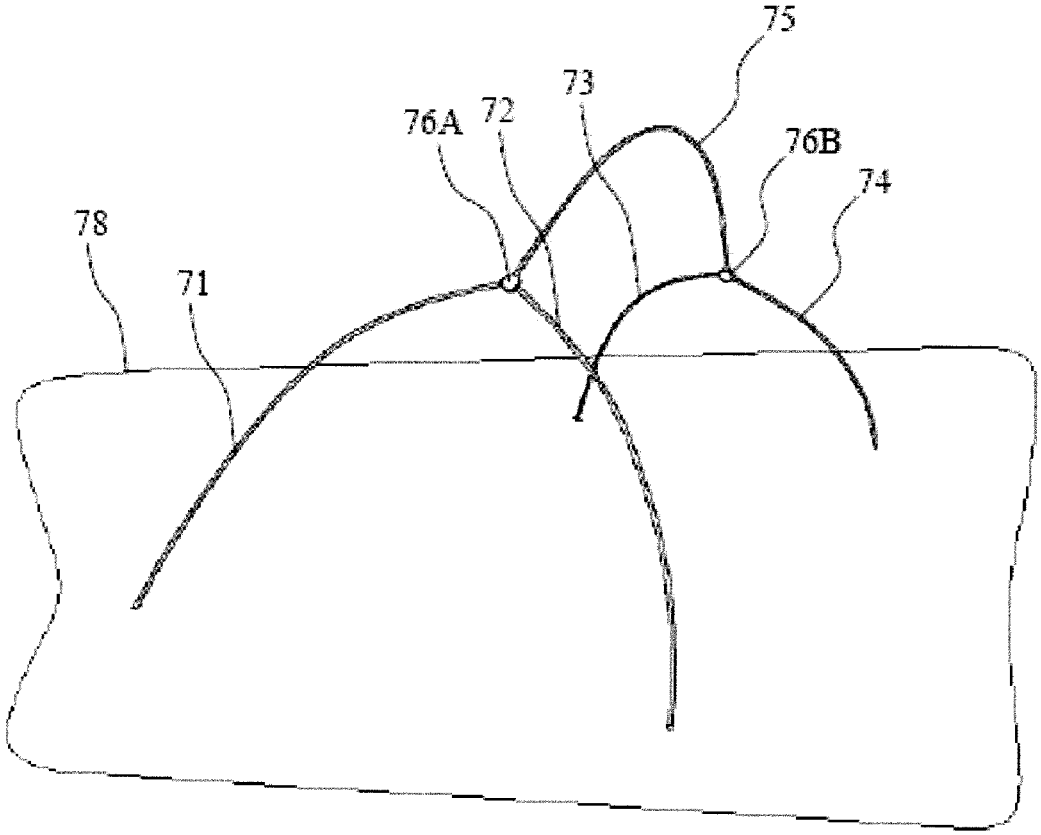
FIG. 8 shows another portable structure with a linking pole.

FIG. 8 shows a pole 71, a pole 72, a pole 73, a pole 74 and a linking pole 75, forming a portable structure suitable to support a tent. One end of each of poles 71, 72, 73 and 74 is on a ground surface 78. A connector 76A connects pole 71, pole 72 and pole 75; a connector 76B likewise connects pole 73, pole 74 and pole 75. Pole 71 and pole 72 are equal in length; pole 73 and 74 are also equal in length but are shorter than poles 71 and 72. The poles shown in FIG. 8 may support a tent that is low at an end corresponding to poles 73 and 74, taller at an end corresponding to poles 71 and 72, and taller still between connectors 76A and 76B. This configuration enables, for example, a relatively tall door to open in the side of a tent (for easy access), while keeping the tent low at both ends. This configuration of a portable structure includes a minimal overall length of poles (in this case, five poles and two connectors) needed to achieve a given peak height and to support the portable structure, which helps minimize weight of the portable structure.

Figure 9:
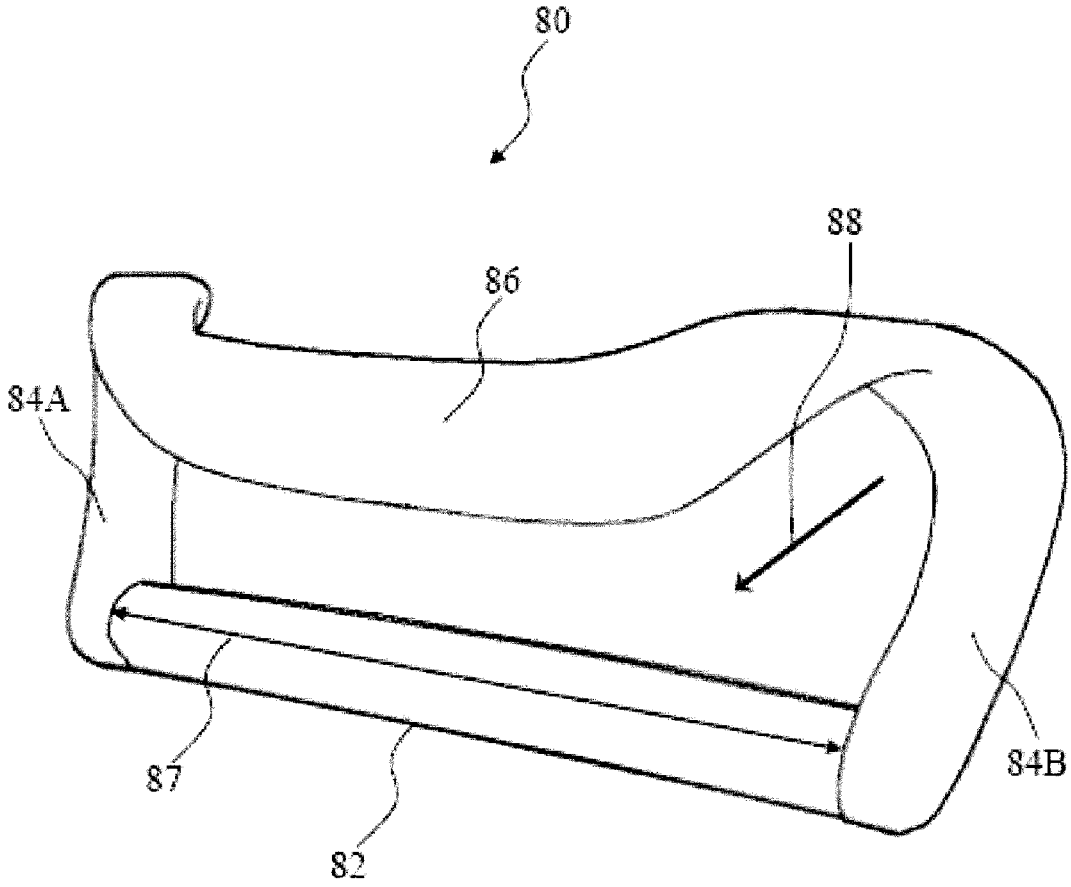
FIG. 9 shows one clip for attaching tent fabric to a pole of a portable structure.

The manner in which a tent fabric connects with a tent pole may affect the structural integrity of the tent. FIG. 9 shows a clip 80 for attaching tent fabric to a tent pole. Clip 80 includes a base member 82, end members 84A and 84B and a top member 86. Arrow 87 shows the length of base member 82 between end members 84A and 84B. Clip 80 may be assembled from component pieces such as, for example, a metal base and another element forming the end members and top member. Alternatively, clip 80 may be a monolithic element. The end members may be made of a relatively rigid but preferably not brittle material such as, for example, acetal-based plastic or polycarbonate.

When a tent uses clip 80, base member 82 may attach to tent fabric in various ways that will be apparent to one skilled in the art of tent design. One way of attaching clip 80 to a tent is to enclose base member 82 within the tent fabric such that substantially all of the length of base member 82 is enclosed, leaving end members 84A, 84B and top member 86C outside the tent fabric. When a tent including clip 80 is erected, a user engages clip 80 to a tent pole (e.g., snaps pole 16 into one of clips 24, FIG. 2) by pushing clip 80 in the direction of arrow 88. End members 84A and 84B bend enough to slip the tent pole through the lengthwise opening and into a cavity bounded by end members 84A and 84B. When a user takes down a tent that uses clip 80, he or she reverses the clipping sequence by grasping top member 86 and pulling clip 80 off the tent pole in the reverse direction of arrow 88. Top member 86 may be adapted for convenient gripping by human fingers, in various ways as a matter of design choice. Adaptation of top member 86 for gripping by fingers is particularly helpful when disengaging clip 80 from a tent pole.

By design, the size of the cavity bounded by end members 84A and 84B matches the size of a tent pole that clip 80 attaches to, so that when engaged to the pole, clip 80 holds the tent pole firmly and does not rotate around the tent pole. As the lengths of base member 82 and top member 86 separate end members 84A and 84B, clip 80 also serves to clasp tent fabric against a tent pole along the length of the clip, instead of at a single point. The length of the clip may vary as a matter of design choice; for example, the distance between the end members may be between about 25 mm and 150 mm. The combination of non-rotation of clip 80 about a tent pole, and the clasping of tent fabric along the length of clip 80, contributes to the structural integrity of a tent.

Figure 10:
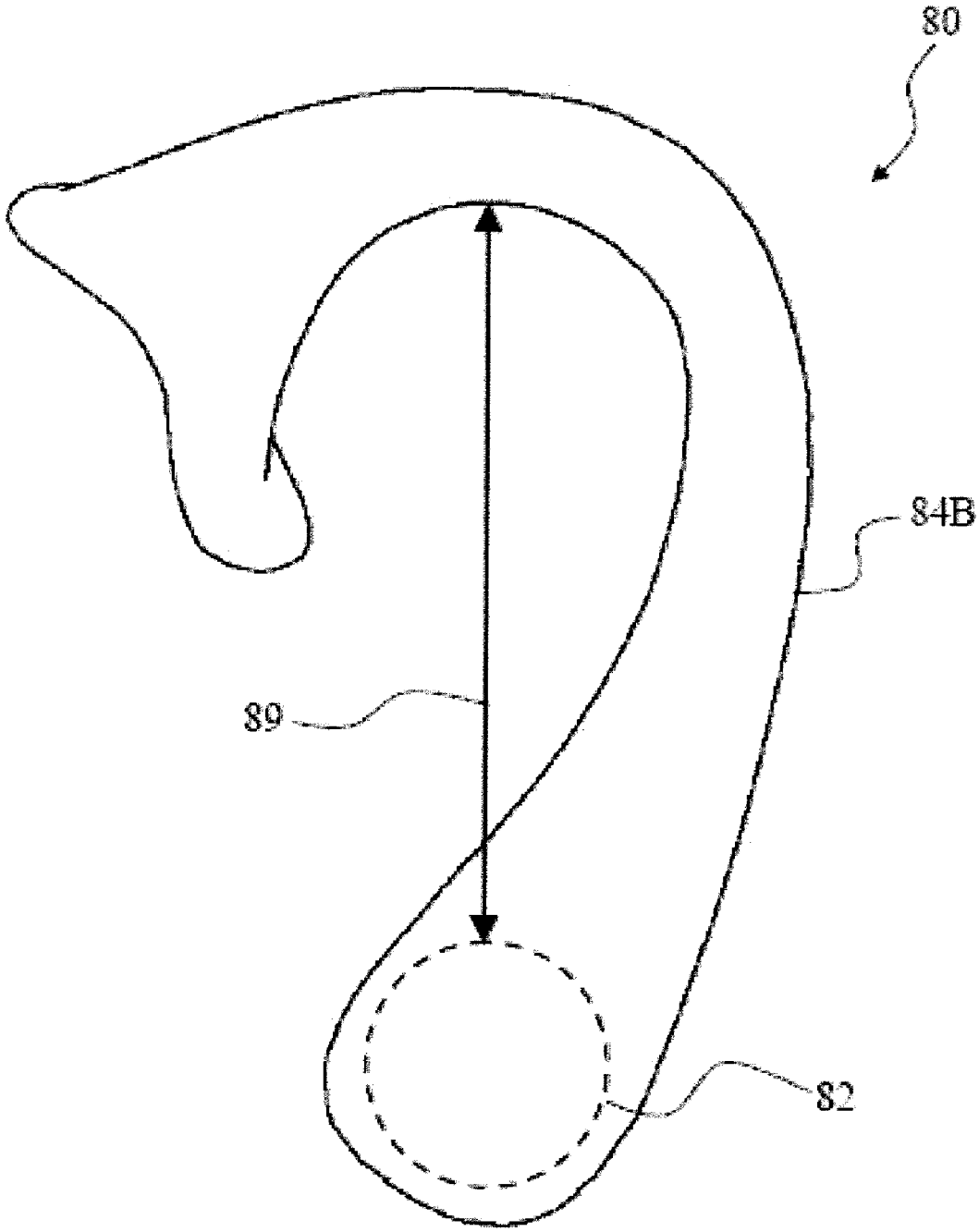
FIG. 10 is an end view of the clip of FIG. 9.

FIG. 10 shows an end view of clip 80. Clip 80 has a low profile, that is, it holds attached tent fabric close to a tent pole rather than dangling the tent fabric at a distance from the pole. FIG. 10 shows end member 84B (end member 84A is hidden behind end member 84B). FIG. 10 also shows the location of base member 82 (also hidden in the current view). Arrow 89 shows the distance between the underside of end member 84B and the top of base member 82. The ratio of the length arrow 87 in FIG. 9 to the length of arrow 89 in FIG. 10 (herein called the "attachment aspect ratio") may be high; for example, as a matter of design choice the attachment aspect ratio may vary from 1.5:1 to 10:1. The low profile of clip 80 allows poles that hold a tent of a given size to be shorter (and lighter in weight) than poles designed to attach to the same tent by higher-profile clips, and the high attachment aspect ratio improves the structural integrity of a tent using clip 80.

One skilled in the art of tent design will appreciate that the design of clip 80 may be modified in other ways without departing from the spirit and scope presented herein. For example, if linking poles (or any tent poles) are modified to constrain the orientation of bends and corners in the poles during use, then clip 80 may be modified to clip to the modified poles. Other changes may likewise be made in the portable structures and poles described herein without departing from the scope hereof.

Figure 11:
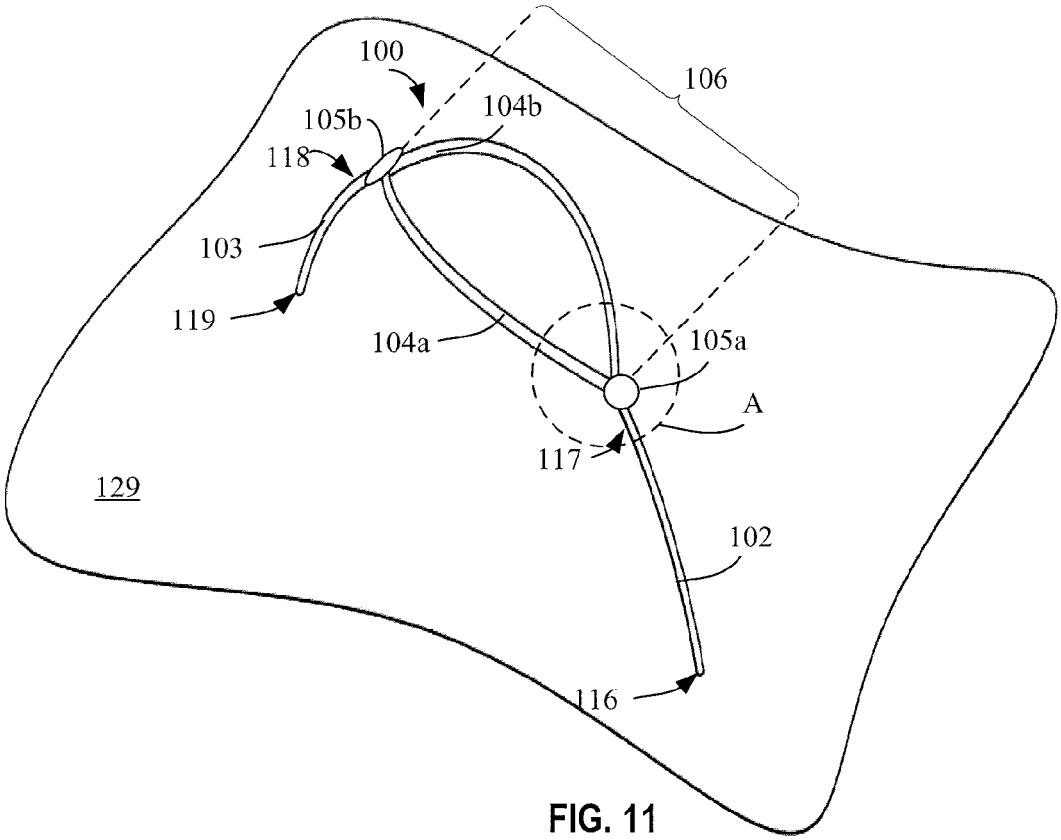
FIG. 11 is a perspective view of another portable structure with a linking pole.

FIG. 11 shows a first support pole 102, a second support pole 103, a first connector 105*a*, a second connector 105*b*and two linking poles 104*a*and 104*b*forming a portable structure 100. Structure 100 is suitable to support tent fabric (not shown) to form a tent. For example, as shown in the upright configuration of FIG. 11, each of first and second support poles 102 and 103 has exactly one lower end (ends 116 and 119, respectively) resting on a ground surface 129. First and second support poles 102 and 103 are flexible poles that may for example be bent or curved into arcs. First connector 105*a* and second connector 105*b* attach to upper ends 117 and 118 of first support pole 102 and second support pole 103, respectively. First and second connectors 105*a* and 105*b* connect linking poles 104*a* and 104*b* with first and second support poles 102 and 103. As shown in FIG. 11, linking poles 104*a* and 104*b* connect to first connector 105*a* at upper end 117 of first support pole 102, and initially branch upward and apart from one another but then converge as they extend to second connector 105*b*. Linking poles 104*a* and 104*b* converge and connect at second connector 105*b* to form an eye shape 106 between first support pole 102 and second support pole 103. An "eye shape" as used herein forms, for example, when two poles connect at acute angles at each of two ends of the two poles, with the two poles spread apart from one another between the two ends. Eye shape 106 increases headroom within a tent formed with structure 100, e.g., along and proximate to linking poles 104*a* and 104*b* that connect first and second support poles 102 and 103. Though FIG. 11 shows eye shape 106, it is appreciated that linking poles 104*a* and 104*b* may also form other variations such as a teardrop shape. A region "A" of portable structure 100 is shown and described in greater detail with respect to FIGS. 12A-C and 13. Like the structure shown in FIG. 8, portable structure 100 includes a minimal overall length of poles (in this case, four poles and two connectors) needed to achieve a given peak height and to support a tent, which helps minimize weight of portable structure 100.

Figure 12A:
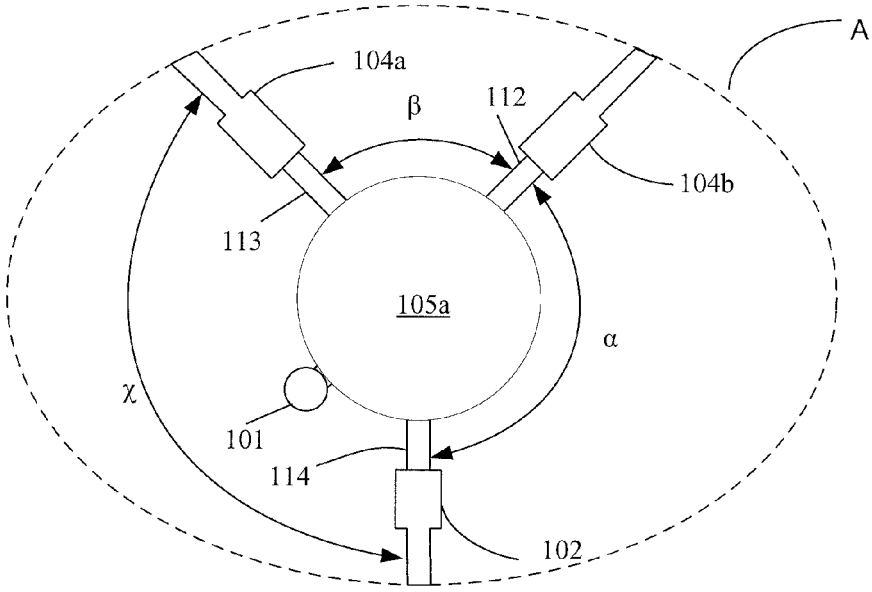
FIG. 12A is an enlarged top view of a region of the portable structure of FIG.

FIG. 12A is an enlarged top view of region A of FIG. 11, showing obtuse angles $\alpha$, $\chi$ formed between linking pole 104*a* and first support pole 102 and between linking pole 104*b* and first support pole 102, respectively, at connector 105*a*. Connector 105*a* may be a keyed joint that facilitates assembly of portable structure 100 with a user-selected orientation of linking poles 104*a*, 104*b* relative to one another and relative to the first support pole 102. For example, a keyed-joint connector 105*a* allows a user to selectively connect linking poles and support poles as further described below, substantially in a single plane (that is, neglecting a small offset between pole 104*b* and poles 102 and 104*a*, as explained in connection with FIG. 12C below). A keyed joint connector 105*a* may likewise maintain the user-selected orientation of linking and support poles (e.g. linking poles 104*a*, 104*b* and first support pole 102) as structure 100 is erected and while structure 100 is maintained or secured in an upright position.

A linking angle $\beta$ forms between upward-branching linking poles 104*a* and 104*b*. In one embodiment, angle $\alpha$ ranges from 120 to 170 degrees and linking angle $\beta$ ranges from 30 to 100 degrees. Linking poles 104*a* and 104*b* may connect with first support pole 102 asymmetrically, such that angles $\alpha$ and $\chi$ have different measurements. In one example, linking pole 104*a* connects with first support pole 102 to form a 140 degree angle $\alpha$, while linking pole 104*b* connects with first support pole 102 via connector 105*a* to form a 170 degree angle $\chi$.

When torque is applied to flexible, arced poles such as linking poles 104*a* and 104*b* and first and second support poles 102 and 103, the poles tend to revert back to their original, straight shape. Connecting linking poles 104*a* and 104*b* with first support pole 102 via first connector 105*a*, in a single plane, allows transfer of torque between first support pole 102 and linking poles 104*a* and 104*b*, within first connector 105*a*. Balancing torque with first connector 105*a* helps to maintain the arced configuration of the poles, thereby increasing the integrity of structure 100.

Figure 12B:
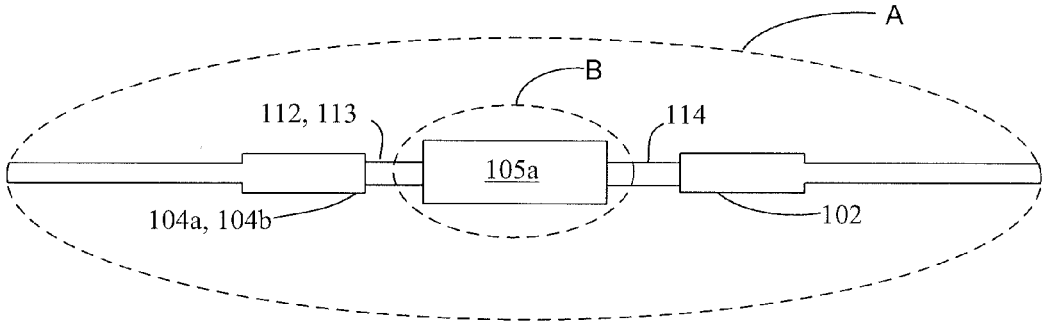
FIG. 12B is an enlarged side view of region A of FIG. 11.

FIG. 12B is a side view of region A of FIG. 11, showing linking poles 104*a* and 104*b* connected to first support pole 102 via connector 105*a*. Linking pole 104*a* hides linking pole 104*b* in this view because poles 104*a* and 104*b* are substantially in a single plane (again, neglecting a small vertical offset between pole 104*b* and poles 102 and 104*a*, as explained in connection with FIG. 12C below). A region B identified in FIG. 12B is shown in further detail in FIG. 12C.

Figure 12C:
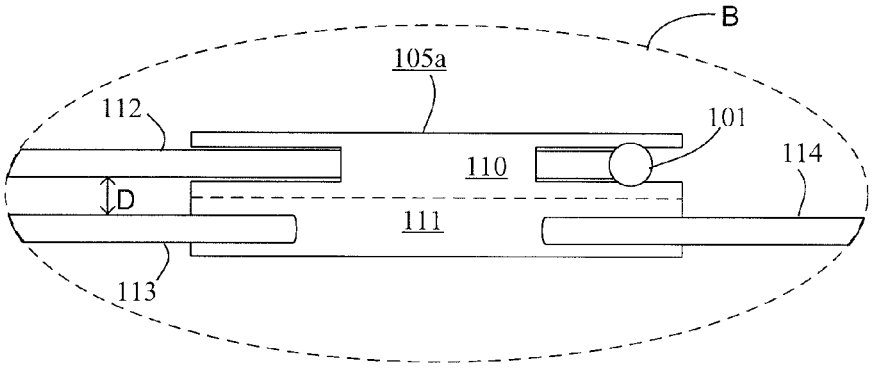
FIG. 12C is an enlarged side view of region B of FIG. 12B.

FIG. 12C is an enlarged side view of region B of FIG. 12B. Connector 105*a* is a stackable hub that includes a top member 110 and a bottom member 111. FIG. 12C shows a slight vertical offset "D" between member 112 and members 113, 114 due to the "stacking" of top member 110 and bottom member 111. Vertical offset "D" is considered negligible for purposes of describing 112, 113 and 114 as being in a "single plane."

Figure 13:
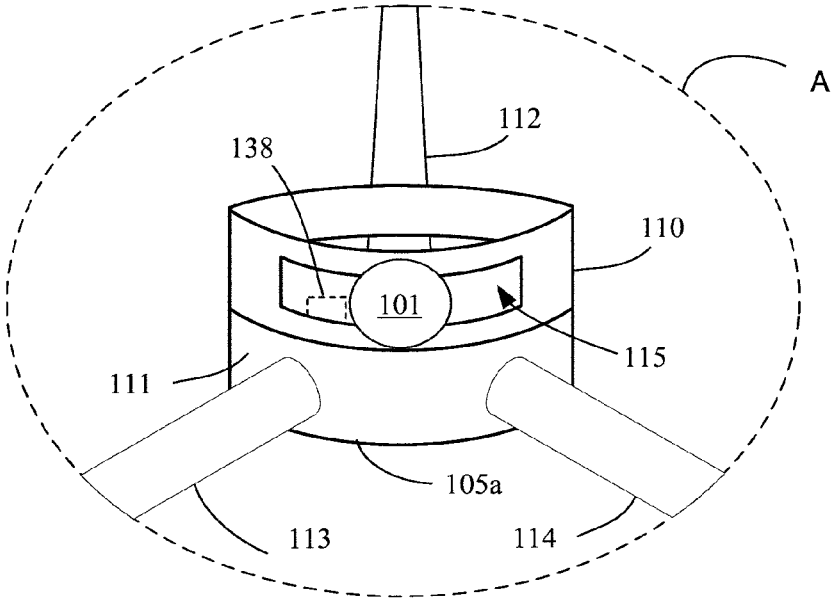
FIG. 13 is an enlarged perspective view of region A of FIGS. 11 and 12.

FIG. 13, in one embodiment, is an enlarged perspective view of region A of FIGS. 11 and 12A-C, showing details of first connector 105*a*, including a top member 110 and a bottom member 111 connected with top member 110. In one embodiment, first connector 105*a* is a stackable hub with attachment fixtures 112, 113 and 114 extending therefrom. Attachment fixtures 112, 113 and 114 of first connector 105*a* for example selectively mate with linking pole 104*a*, linking pole 104*b* and first support pole 102, respectively. Attachment fixtures 112, 113 and 114 are shown as generally cylindrical in FIG. 13A, but it is appreciated that other types of fixtures may be utilized for mounting to poles. Attachment fixture 112 may be a movable member that intersects and extends from an open channel 115 formed by top member 110. Open channel 115 for example accommodates rotation and/or lateral movement of attachment fixture 112 within top member 110. Movable attachment fixture 112 has one enlarged end 101 for preventing movable member 112 from detaching from connector 105*a* (e.g., by sliding out through open channel 115). Attachment fixtures 113 and 114 are shown in FIG. 13 as fixed members extending from bottom member 111 of first connector 105a. The "stacking" of top member 110 and bottom member 111 introduces a slight vertical offset between movable attachment fixture 112 and fixed attachment fixtures 113, 114 that is considered negligible for purposes of describing 112, 113 and 114 as being connected in a "single plane." Also, it is understood that although poles 102, 104*a* and 104*b* are substantially in the single plane at connector 105*a*, they are flexible and depart from being in a single plane away from connector 105*a*.

A user of structure 110 for example positions movable attachment fixture 112 along open channel 115 to manipulate a linking angle β between movable attachment fixture 112 and one or both of fixed attachment fixtures 113 and 114. An anchoring member 138 may be used to secure movable attachment fixture 112 at a selected position, thus maintaining corresponding linking angle β between movable attachment fixture 112 and one or both fixed attachment fixtures 113 and 114. Such an anchoring member may likewise prevent rotation or lateral movement of movable attachment fixture 112 beyond the selected position, e.g., allowing movement up to, but not beyond, the selected position. It will be appreciated that anchoring member 138 is shown in exemplary position and configuration only, as indicated by the illustrative dashed line. One or more alternate positions of anchoring member 138 are within the scope hereof.

Although moveable attachment fixture 112 is described, for illustrative purposes, as mating with linking pole 104*a*, it is understood that moveable attachment fixture 112 may also selectively connect with first support pole 102 or with linking pole 104*b* to achieve a desired configuration or adjustability of portable structure 100. It is likewise understood that structures and functions shown and described with respect to connector 105*a* may equally extend to connector 105*b*.

Adjusting linking angle β between moveable attachment fixture 112 and fixed attachment fixture 113 and/or 114 in turn adjusts one or more angles among poles connected with the moveable and fixed attachment fixture or members. For example, when linking pole 104*a* connects with movable attachment fixture 112 and fixed attachment fixtures 113 and 114 connect, respectively, with linking pole 104*b* and first support pole 102, adjusting linking angle β adjusts angle and position of linking pole 104*a* relative to linking pole 104*b* and first support pole 102. Movable attachment fixture 112 thus allows a user of structure 100 to achieve a wide variety of configurations for portable structure 100 via relatively minor angular adjustments at connector 105*a*, and likewise, at connector 105*b*.

For example, each of first and second connectors 105*a* and 105*b* may include one movable attachment fixture (e.g., movable attachment fixture 112.) In one embodiment, first connector 105*a* includes movable attachment fixture 112 and second connector 105*b* has a corresponding movable attachment fixture (not shown). When first connector 105*a* and second connector 105*b* mate with linking pole 104*a*, relative position among linking pole 104*a*, linking pole 104*b* and first support pole 102 may be adjusted at one or both of connectors 105*a* and 105*b*, e.g., by varying corresponding angles α or β. A shape, height and/or volume of structure 100 may therefore be varied by adjusting angles between attachment fixtures (e.g., attachment fixtures 112, 113 and 114) at one or both of connectors 105*a* and 105*b*. For example, increasing linking angle at one or both of connectors 105*a* and 105*b* (e.g., from 120 degrees to 170 degrees) increases headroom of a tent formed with structure 100, at least along linking pole 104*a*.

In one embodiment, linking pole 104*a* mates with movable attachment fixture 112 at first connector 105*a* and with a fixed attachment fixture (similar to fixed attachment fixtures 113 and 114) at second connector 105*b*. Linking pole 104*b* in turn connects with fixed attachment fixture 113 or 114 at first connector 105*a*, and with a moveable attachment fixture (similar to moveable attachment fixture 112) at second connector 105*b*. Position of linking pole 104*a* may thus be adjusted at first connector 105*a* and position of linking pole 104*b* may be adjusted at second connector 105*b*. Linking angle β(see FIG. 12A) is thereby adjustable at opposing sides of structure 100. Adjusting linking angle β between linking poles 104*a* and 104*b* by manipulating one or both of connectors 105*a* and 105*b* for example provides variable roof or top configurations for structure 100.

Though first connector 105*a* is shown as having a cylindrical shape (sometimes denoted a "hub" herein), it is appreciated that first connector 105*a* and/or second connector 105*b* may take on a variety of shapes and sizes. In one embodiment, connectors may include three or more fixed attachment fixtures extending fixedly therefrom; that is, such connectors may not include moveable attachment fixtures like attachment fixture 112.

Figure 14:
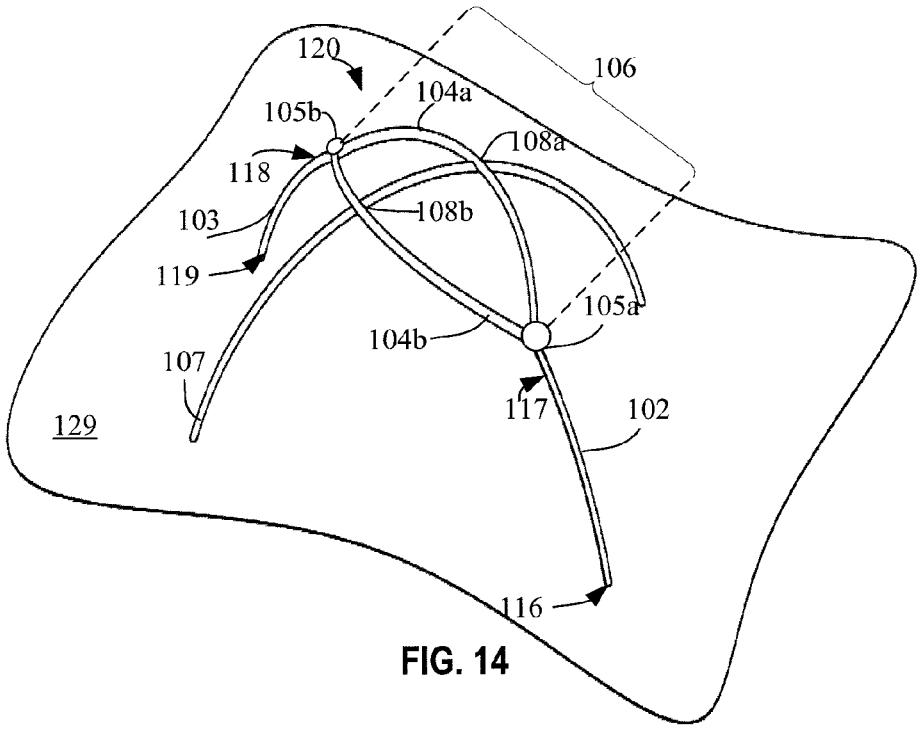
FIG. 14 shows another portable structure with a linking pole.

FIG. 14 shows a portable structure 120 with first and second support poles 102 and 103, first and second connectors 105*a* and 105*b*, linking poles 104*a* and 104*b* and a third support pole 107. When in an upright position, as shown in FIG. 15, structure 120 is suitable for supporting tent fabric (not shown) to form a tent.

Linking poles 104*a* and 104*b* connect with first support pole 102 at first connector 105*a* and with second support pole 103 at opposing second connector 105*b*. As shown in FIG. 14, connected linking poles 104*a* and 104*b* arc upward and apart from one another between first and second connectors 105*a* and 105*b*, to form eye shape 106 that for example increases headroom within a tent formed with structure 100.

Tent height is therefore adjustable according to a height of linking poles 104*a* and 104*b*, which may be adjusted via angular manipulation at connector 105*a* and/or connector 105*b*. Internal tent volume is likewise adjustable as a function of the height of or spacing between linking poles 104*a* and 104*b*, which again may be adjusted at connector 105*a* and/or connector 105*b*. For example, tent height and the internal volume correlate with linking angle β formed between linking pole 104*a* and 104*b*. When linking angle β is 50 degrees, the tent has a given height. When linking angle β is 80 degrees, the height of the tent decreases while internal volume of the tent increases. In other words, as linking angle β decreases, tent height increases, and as linking angle β increases, height decreases and internal tent volume increases.

As shown in FIG. 14, third support pole 107 forms an arc crossing linking poles 104*a* and 104*b* at crossing points 108*a* and 108*b*, with ends of support pole 107 resting on ground surface 129. Support pole 107 reinforces structure 120 and increases floor space and internal volume of a tent formed with structure 120.

FIG. 15 shows a portable structure 130 with first, second, third and fourth support poles 132*a*, 132*b*, 132*c* and 132*d*, first and second connectors 133*a* and 133*b* and two linking poles 134*a* and 134*b*. Additional linking poles may be provided with structure 130, as a matter of design preference.

Structure 130 may support tent fabric (not shown) to form a tent. In an upright configuration, each of support poles 132*a*, 132*b*, 132*c* and 132*d* has one lower end resting on a ground surface 136. Support poles 132*a* and 132*b* connect with connector 133*a* and branch downward and apart from one another. Support poles 132*c* and 132*d* connect with connector 133*b* and branch downward and apart from one another. Support poles 132*a*, 132*b*, 132*c* and 132*d* for example add stability to structure 130 and increase internal volume within the aforementioned tent. Linking poles 134*a* and 134*b* connect with first connector 133*a* and branch upward and apart from one another as they extend to connector 133*b*, where they converge and connect to form an eye shape 131 between connectors 133*a* and 133*b*. Eye shape 131 serves to increase internal volume within a tent formed with structure 130, in particular, between connector 133*a* and connector 133*b*. Linking poles 134*a* and 134*b* are flexible poles that may bend into an arc shape. Like the structures shown in FIG. 8 and FIG. 11, portable structure 130 includes a minimal overall length of poles (in this case, four short support poles, two longer linking poles and two connectors) needed to achieve a given peak height and to support a tent, which helps minimize weight of portable structure 130.

In one embodiment, structure 130 includes a fifth support pole similar to third support pole 107, FIG. 14. Such fifth support pole (not shown in FIG. 15) for example crosses connected linking poles 134*a* and 134*b* at two crossing points (see, e.g., crossing points 108*a* and 108*b*, FIG. 14) and reinforces structure 130. As described above with respect to FIG. 15, the fifth support pole may increase floor space and internal volume of a tent formed with structure 130.

FIG. 16 is an enlarged perspective view of region C of FIG. 15, in one embodiment. FIG. 16 shows that connector 133*a* is a stackable hub having a top member 121, a second member 122, connected to top member 121, and a bottom member 123, connected to second member 122. Top member 121 has a first movable attachment fixture 124 extending therefrom and forms a first channel 127 for accommodating the rotation and/or lateral movement of first movable attachment fixture 124. Two fixed attachment fixtures 125 and 137 extend from the second member 122. Bottom member 123 forms a second channel 128 to accommodate rotational and/or lateral movement of a second movable attachment fixture 126 therethrough. At least two anchoring members may be used to fasten moveable attachment fixtures 124 and 126 in a selected position, thereby maintaining an angle of for example 60 degrees between one of fixed attachment fixtures such as fixed attachment 125 and moveable attachment fixtures 124 and/or 126. Each of movable attachment fixtures 124 and 126 has one enlarged end such as enlarged end 135 for preventing movable members 124 and 126 detaching from connector 133*a* by sliding out of open channels 127 and 128, respectively. Having two movable attachment fixtures 124 and 126 serves to further increase a number of adjustable angles that are available between fixed attachment fixtures 125 and 137 and movable attachment fixtures 124 and 126.

Figure 17:
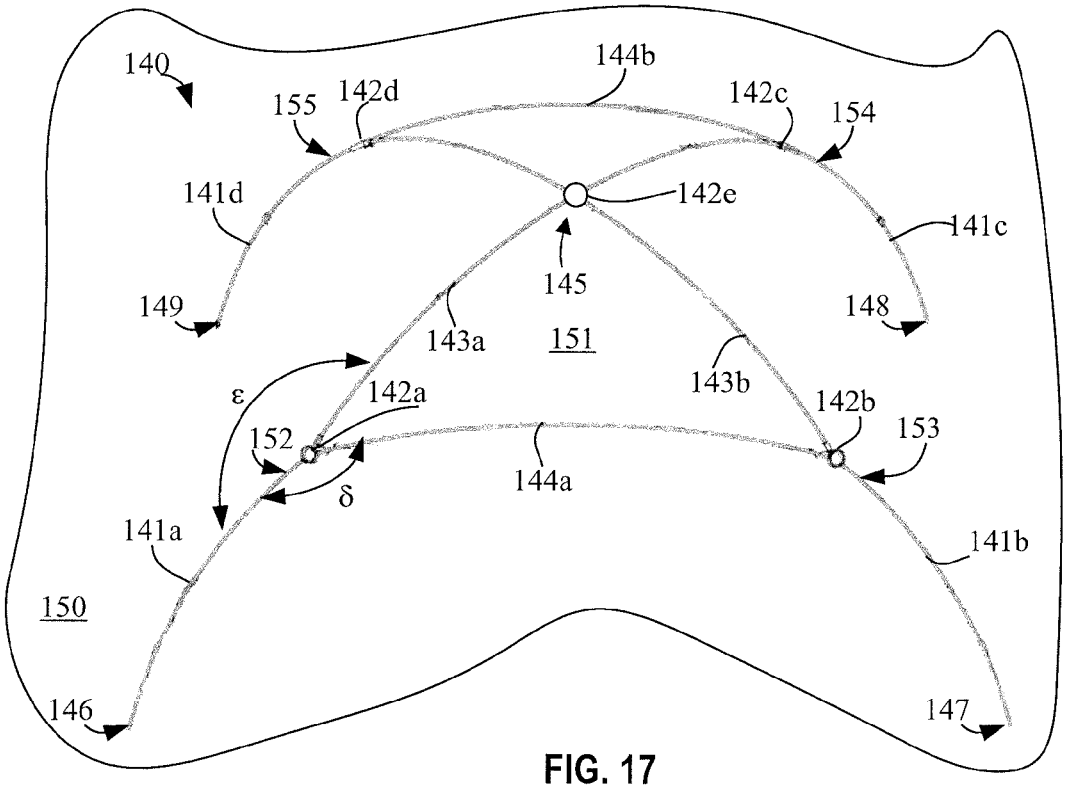
FIG. 17 shows another portable structure with a linking pole.

FIG. 17 shows a portable structure 140. Structure 140 includes four support poles 141*a*, 141*b*, 141*c* and 141*d*, four connectors 142*a*, 142*b*, 142*c* and 142*d* and four linking poles 143*a*, 143*b*, 144*a* and 144*b*. Structure 140 may for example support tent fabric (not shown) to form a tent. As shown, each of support poles 141*a*, 141*b*, 141*c*, 141*d* has a lower end 146, 147, 148 and 149 respectively that rests on a ground surface 150. First, second, third and fourth connectors 142*a*-142*d* attach at upper ends 152, 153, 154, and 155 of support poles 141*a*, 141*b*, 141*c* and 141*d*, respectively. In an upright configuration, linking pole 143*a* connects with first support pole 141*a* and support pole 141*c* via connectors 142*a* and 142*c*. Linking pole 143*b* connects with support pole 141*b* and support pole 141 d via connectors 142*b* and 142*d* Linking poles 143*a* and 143*b* cross at point 145, which is for example an apex of structure 140. Structure 140 may optionally include a fifth connector 142*e* that connects linking poles 143*a* and 143*b* at point 145, improving stability of structure 140. Linking pole 144*a* connects with support pole 141*a* and support pole 141*b* via connectors 142*a* and 142*b*. Linking pole 144*b* connects with support pole 141*c* and support pole 141*d* via connectors 142*c* and 142*d*. Linking poles 144*a*, 144*b* may increase headroom and internal volume within a tent formed with structure 140. For example, linking pole 144*a* supports a tent fabric to prevent the fabric from sagging inward at a triangular side 151 formed between point 145 and lower ends of support poles 141*a* and 141*b*. The linking poles (e.g. poles 143*a*, 144*a*) and the upper ends of the support poles form obtuse angles δ, ϵ as shown.

Certain changes may be made in the above systems and methods without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

The invention claimed is:

1. A portable tent structure, comprising:

first, second, third and fourth support poles, each having a lower end for resting on a ground surface when the tent structure is erected;

first, second, third and fourth three-way connectors for accepting upper ends of the first, second, third and fourth support poles, respectively;

a first linking pole for fitting at its ends with the first and second three-way connectors to link the first and second connectors;

a second linking pole for fitting at its ends with the third and fourth three-way connectors to link the third and fourth connectors;

a third linking pole for fitting at its ends with the first and third three-way connectors to link the connectors; and a fourth linking pole for fitting at its ends with the second and fourth three-way connectors to link the connectors;

wherein the third and fourth linking poles cross one atop the other substantially at a center of the tent structure when the tent structure is erected.

2. The portable tent structure of claim 1, wherein each angle formed between the linking poles and the support poles is an obtuse angle.

3. The portable tent structure of claim 1, wherein the three-way connectors join the support poles with the linking poles substantially in a single plane.

4. The portable tent structure of claim 1, wherein the third and fourth linking poles form framework for a roof of the tent structure when the third linking pole joins with the first and third connectors and the fourth linking pole joins with the second and fourth connectors.

5. The portable tent structure of claim 1, the three-way connectors comprising keyed joints for facilitating assembly of the tent structure with a selected orientation of the linking poles and the support poles relative to one another, and for maintaining the selected orientation.

6. The portable tent structure of claim 1, each of the three-way connectors comprising a stackable hub having:

a top member forming an open channel that accommodates movement of a moveable attachment fixture therein; and a bottom member connected with the top member and including at least two attachment fixtures extending therefrom;

wherein movement of the moveable attachment fixture along the open channel adjusts an angle between the movable attachment fixture and at least one of the attachment fixtures extending from the bottom member.

7. The portable tent structure of claim 6, wherein each of the at least two attachment fixtures extending from the bottom member of the hub is fixed with respect to the bottom member.

8. The portable tent structure of claim 6, wherein one of the at least two attachment fixtures extending from the bottom member of the hub is movable with respect to the bottom member.

9. The portable tent structure of claim 6, further comprising an anchoring mechanism for releasably securing the movable attachment figure with the top member at a selected position.

10. The portable tent structure of claim 6, the moveable attachment fixture and the fixed attachment fixtures of the hub having keyed joints.

11. The portable tent structure of claim 1, further comprising a fifth connector for securing the third and fourth linking poles substantially at the center of the tent structure.

12. The portable tent structure of claim 11, the fifth connector having a first channel for accepting the third linking pole and a second channel for accepting the fourth linking pole.

13. The portable tent structure of claim 12, the fifth connector comprising a two-channeled pass-through hub or clip-on connector.

14. The portable tent structure of claim 1, wherein each of the three-way connectors connects the corresponding poles substantially in a single plane.

15. A portable tent structure, comprising:

first, second, third and fourth support poles each having one lower end for resting on a ground surface when the structure is erected;

first, second, third and fourth linking poles for attaching with upper ends of the first, second, third and fourth support poles;

a first three-way connector attaching the first support pole, the first linking pole and the third linking pole when the first support pole is in an upright configuration;

a second three-way connector attaching the second support pole, the first linking pole and the fourth linking pole when the second support pole is in the upright configuration;

a third three-way connector attaching the third support pole, the second linking pole and the third linking pole when the second support pole is in the upright configuration; and a fourth three-way connector attaching the fourth support pole, the second linking pole and the fourth linking pole when the second support pole is in the upright configuration;

wherein the third and fourth linking poles cross one atop the other substantially at a center of the tent structure, when the structure is erected, and wherein the three-way connectors join the support poles with the linking poles substantially in a single plane.

16. The portable tent structure of claim 15, wherein each angle formed between the linking poles and the support poles is an obtuse angle.

17. The portable tent structure of claim 15, further comprising a tent fabric supported by the linking poles to at least partially enclose the structure.

18. The portable tent structure of claim 17, the first and second linking poles increasing internal volume of the tent structure, when the structure supports the tent fabric.

19. The portable tent structure of claim 15, further comprising a fifth connector for securing the third and fourth linking poles substantially at the center, to enhance stability of the tent structure.

20. A portable tent structure, comprising:

first, second, third and fourth support poles each having one lower end for resting on a ground surface when the structure is erected;

first, second, third and fourth linking poles for attaching with upper ends of the first, second, third and fourth support poles;

a first three-way connector attaching the first support pole, the first linking pole and the third linking pole when the first support pole is in an upright configuration;

a second three-way connector attaching the second support pole, the first linking pole and the fourth linking pole when the second support pole is in the upright configuration;

a third three-way connector attaching the third support pole, the second linking pole and the third linking pole when the second support pole is in the upright configuration; and a fourth three-way connector attaching the fourth support pole, the second linking pole and the fourth linking pole when the second support pole is in the upright configuration;

wherein the third and fourth linking poles cross substantially at a center of the tent structure when the structure is erected, to form framework for a tent ceiling; and wherein the three-way connectors join the support poles with the linking poles (a) at obtuse angles, and (b) substantially in a single plane.

21. The portable tent structure of claim 20, further comprising a fifth connector for securing the third and fourth linking poles substantially at the center, to enhance stability of the tent structure.

* * * * *